US008359712B2

(12) United States Patent
Saitou et al.

(10) Patent No.: US 8,359,712 B2
(45) Date of Patent: Jan. 29, 2013

(54) VEHICLE DOOR OUTER HANDLE DEVICE

(75) Inventors: Tadashi Saitou, Miyazaki (JP); Teruo Yamazaki, Saitama (JP); Takashi Ogawa, Saitama (JP); Noriyuki Toshitsuna, Saitama (JP); Katsuya Ashizawa, Saitama (JP)

(73) Assignees: Kabushiki Kaisha Honda Lock, Miyazaki (JP); Honda Motor Co., Ltd, Tokyo (JP)

( * ) Notice: Subject to any disclaimer, the term of this patent is extended or adjusted under 35 U.S.C. 154(b) by 267 days.

(21) Appl. No.: 12/755,536

(22) Filed: Apr. 7, 2010

(65) Prior Publication Data

US 2010/0293753 A1 Nov. 25, 2010

(30) Foreign Application Priority Data

May 21, 2009 (JP) ..... 2009-122779

(51) Int. Cl.
*A45C 3/00* (2006.01)

(52) U.S. Cl. ..... 16/412; 296/1.02; 70/455; 70/DIG. 56; 292/336.3

(58) Field of Classification Search ..... 16/412, 16/110.1; 292/336.3, DIG. 31; 70/423–428, 70/455, 208, DIG. 43, DIG. 56; 296/1.02
See application file for complete search history.

(56) References Cited

U.S. PATENT DOCUMENTS

| | | | | | |
|---|---|---|---|---|---|
| 2,070,955 | A * | 2/1937 | Parisoe | ..... | 70/455 |
| 2,217,730 | A * | 10/1940 | Cooley | ..... | 70/455 |
| 2,247,592 | A * | 7/1941 | Swift | ..... | 70/455 |
| 2,585,331 | A * | 2/1952 | King | ..... | 70/455 |
| 2,658,376 | A * | 11/1953 | Shank | ..... | 70/455 |
| 2,670,623 | A * | 3/1954 | Haltenberger | ..... | 70/455 |
| 6,240,755 | B1 * | 6/2001 | Da Silva | ..... | 70/423 |
| 7,526,936 | B2 * | 5/2009 | Niskanen et al. | ..... | 70/423 |
| 2008/0190157 | A1 * | 8/2008 | Mizuno | ..... | 70/455 |

FOREIGN PATENT DOCUMENTS

| | | | |
|---|---|---|---|
| JP | 58-222260 | A | 12/1983 |
| JP | 6-43383 | | 2/1994 |
| JP | 6-43383 | A | 11/1994 |
| JP | 7-6419 | A | 2/1995 |
| JP | 11-241532 | A | 9/1999 |
| JP | 2002-295059 | A | 10/2002 |
| JP | 2002-295063 | A | 10/2002 |
| JP | 2008-088669 | | 4/2008 |
| JP | 2008-248635 | A | 10/2008 |

* cited by examiner

*Primary Examiner* — William L. Miller
(74) *Attorney, Agent, or Firm* — Arent Fox LLP

(57) ABSTRACT

In a vehicle door outer handle device, an inwardly recessed housing recess is provided in a base member fixed to a vehicle door; an outer handle having an operation portion is pivotably supported on the base member while being able to pivot to an operated position in accordance with pulling of the operation portion and being spring-biased toward a non-operated position side, at least part of the operation portion being disposed in the housing recess; and a cylinder lock is mounted on the base member so that a key hole is covered at least in a state in which the outer handle is in the non-operated position. In the outer handle device, a cover member is detachably mounted on the base member so as to cover the key hole, the cover member being formed as a separate body from the outer handle so as to form part of the housing recess while forming a design surface of the base member. Accordingly, it is possible to provide a vehicle door outer handle device that makes it difficult for the position of a cylinder lock to be identified.

7 Claims, 7 Drawing Sheets

VEHICLE DOOR OUTER HANDLE DEVICE

BACKGROUND OF THE INVENTION

1. Field of the Invention

The present invention relates to a vehicle door outer handle device in which an inwardly recessed housing recess is provided in a base member fixed to a vehicle door, an outer handle having an operation portion is pivotably supported on the base member while being able to pivot to an operated position in accordance with pulling of the operation portion and being spring-biased toward a non-operated position side, at least part of the operation portion being disposed in the housing recess, and a cylinder lock is mounted on the base member so that a key hole is covered at least in a state in which the outer handle is in the non-operated position.

2. Description of the Related Art

An outer handle device in which, in order to prevent water from entering a key hole of a cylinder lock mounted on a base member, the key hole is hidden by a cover part provided so as to be connected to an operation portion of an outer handle is known from Japanese Patent Application Laid-open No. 11-241532. Furthermore, an outer handle device used in a smart entry system in which a cylinder lock mounted on a base member as an emergency measure when there is a failure, etc. is covered by a cover member so that it is not visible from the outside in a normal state in order to enhance theft-proofness is known from Japanese Patent Application Laid-open No. 2002-295063.

However, in the arrangement disclosed by Japanese Patent Application Laid-open No. 11-241532, since the key hole is covered by the cover part provided so as to be connected to the operation portion of the outer handle, regardless of whether the cylinder lock is in use or not, when the outer handle is operated, the key hole is exposed. Because of this, the position of the cylinder lock is easily identified by a third party, thus making it undesirable from the viewpoint of theft-proofness. Furthermore, in the arrangement disclosed by Japanese Patent Application Laid-open No. 2002-295063, the cover member projects from the base member so as to face an end part of the outer handle, and this also allows a third party to easily identify the position of the cylinder lock.

SUMMARY OF THE INVENTION

The present invention has been accomplished in light of such circumstances, and it is an object thereof to provide a vehicle door outer handle device that makes it difficult for the position of a cylinder lock to be identified.

In order to achieve the object, according to a first feature of the present invention, there is provided a vehicle door outer handle device in which an inwardly recessed housing recess is provided in a base member fixed to a vehicle door, an outer handle having an operation portion is pivotably supported on the base member while being able to pivot to an operated position in accordance with pulling of the operation portion and being spring-biased toward a non-operated position side, at least part of the operation portion being disposed in the housing recess, and a cylinder lock is mounted on the base member so that a key hole is covered at least in a state in which the outer handle is in the non-operated position, wherein a cover member is detachably mounted on the base member so as to cover the key hole, the cover member being formed as a separate body from the outer handle so as to form part of the housing recess while forming a design surface of the base member.

In accordance with the first feature of the present invention, since the cover member is a separate body from the outer handle and is detachably mounted on the base member, the key hole of the cylinder lock is not exposed to the outside by operation of the outer handle. Furthermore, since the cover member forms a design surface of the base member, it is difficult for it to be recognized as a cover member when viewed from the outside of the vehicle door, and since it is also difficult to identify the position of the cylinder lock, excellent theft-proofness can be obtained.

According to a second feature of the present invention, in addition to the first feature, the operation portion and the cover member detachably mounted on the base member by pressing against an outer face of the base member are formed so that the operation portion and part of the cover member overlap one another when viewed from the outside of the vehicle door so that the operation portion abuts against the cover member from the outside in a state in which the outer handle is in the non-operated position.

Furthermore, in accordance with the second feature of the present invention, since when the cover member is mounted on the base member, the operation portion of the outer handle spring-biased toward the non-operated position side abuts against the cover member when the outer handle is at the non-operated position, the cover member, which is mounted on the base member by a pushing operation against the outer face of the base member, can be reliably mounted on the base member.

According to a third feature of the present invention, in addition to the first or second feature, an engagement hole is provided in the base member, a mounting projection is provided on the cover member so as to be insertable into the engagement hole from the outside of the vehicle door, the mounting projection having at its tip end an engagement claw that can resiliently engage with an inner end edge of the engagement hole, portions of engagement release means, which has an engagement release-operation portion projecting outward from an outer face of the base member and is able to release engagement of the engagement claw with the inner end edge of the engagement hole in accordance with operation of the engagement release-operation portion, apart from the engagement release-operation portion are disposed on an inner face side of the base member, and the engagement release-operation portion is disposed at a position in which it is covered by the operation portion of the outer handle in the non-operated position.

In accordance with the third feature of the present invention, since the cover member is mounted on the base member by resiliently engaging, with the inner end edge of the engagement hole provided on the base member, the engagement claw at the tip end of the mounting projection provided on the cover member so that it can be inserted into the engagement hole from the outside of the vehicle door, and the engagement release means releases engagement of the engagement claw with the inner end edge of the engagement hole in accordance with operation of the engagement release-operation portion, the engagement release-operation portion being disposed at a position covered by the operation portion of the outer handle in the non-operated position, it is only possible to operate the engagement release-operation portion in a state in which the operation portion is pulled so as to pivot the outer handle to the operated position, thereby making it difficult for the engagement release-operation portion to be operated undesirably by tampering, etc.

According to a fourth feature of the present invention, in addition to the third feature, the engagement release means comprises a pressing member that can abut against the engagement claw so that it can exert on the engagement claw in accordance with operation of the engagement release-operation portion a pressing force in a direction that releases engagement of the engagement claw with the inner end edge of the engagement hole, and at least one of abutment faces of the engagement claw and the pressing member is formed as an inclined face that converts the pressing force exerted on the engagement claw by the pressing member into a force that drives the mounting projection toward the outside of the vehicle door.

Moreover, in accordance with the fourth feature of the present invention, since engagement of the engagement claw with the inner end edge of the engagement hole is released by the pressing member of the engagement release means abutting against the engagement claw and exerting a pressing force on the engagement claw, at least one of the abutment faces of the engagement claw and the pressing member is formed as an inclined face, and the pressing force acting on the engagement claw from the pressing member is converted into a force driving the mounting projection toward the outside of the vehicle door, it is easy to detach the cover member from the base member.

The above description, other objects, characteristics and advantages of the present invention will be clear from detailed descriptions which will be provided for the preferred embodiment referring to the attached drawings.

DESCRIPTION OF THE PREFERRED EMBODIMENT

An embodiment of the present invention will be explained below with reference to the attached drawings.

Figure 1:
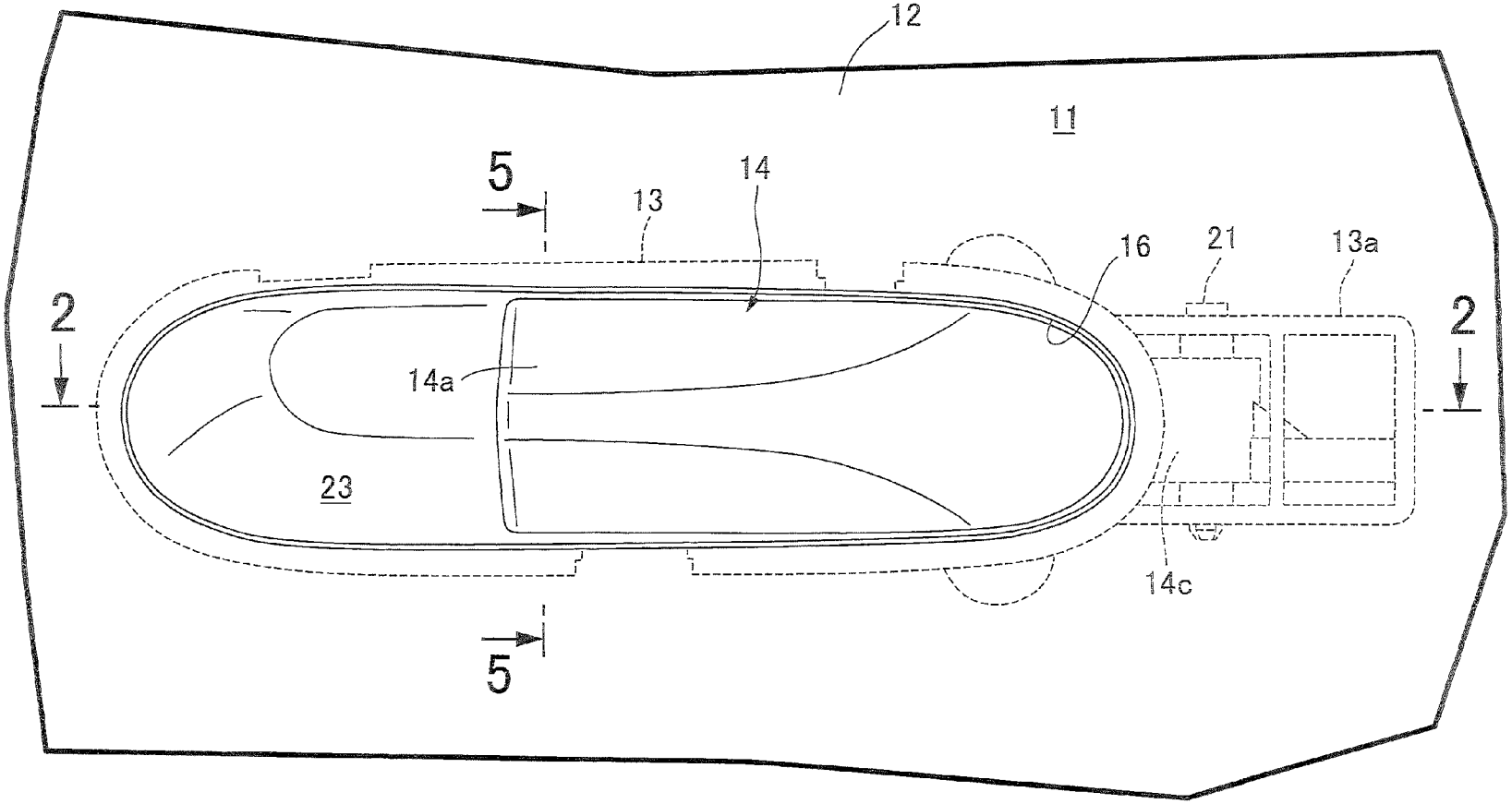
FIG. 1 is a front view of an outer handle device.

An embodiment of the present invention is explained by reference to FIG. 1 to FIG. 7; first in FIG. 1 to FIG. 3, an outer handle device according to the present invention is mounted on an outer panel 12 of a vehicle door 11, which is for example a side door of a passenger vehicle, this outer handle device including a base member 13 fixed to the outer panel 12, an outer handle 14 pivotably supported by the base member 13, and a cylinder lock 15 mounted on the base member 13.

The outer panel 12 is provided with an aperture 16 extending lengthwise in the fore-and-aft direction of the vehicle (left-and-right direction in FIG. 1 and FIG. 2), and the base member 13 is fixed to an inner face side of the outer panel 12 so as to close the aperture 16. The base member 13 is provided with a through hole 17 and first and second recesses 18 and 19 disposed at positions spaced from the through hole 17 in the fore-and-aft direction of the vehicle and connected to each other. The first recess 18 is disposed more on the through hole 17 side than the second recess 19, and the second recess 19 is formed deeper than the first recess 18 so as to form between itself and the first recess 18 a step 20 facing the side opposite to the through hole 17.

The outer handle 14 is formed from a synthetic resin so as to integrally have an operation portion 14*a* extending in the fore-and-aft direction of the vehicle so as to enable a user of the vehicle to grip one end part thereof and operate it, a leg portion 14*b* connected to the other end side of the operation portion 14*a* so as to be substantially perpendicular thereto, and a support arm portion 14*c* connected to the extremity side of the leg portion 14*b*, the extremity of the support arm portion 14*c* being pivotably supported on a support portion 13*a* provided integrally with the base member 13 via a support shaft 21. Moreover, a spring, which is not illustrated, is provided between the support portion 13*a* and the support arm portion 14*c*, and the outer handle 14 is spring-biased toward a non-operated position side on which the operation portion 14*a* is in proximity to the outer face of the base member 13.

A resilient member 22 is mounted on the inner face side of the operation portion 14*a* of the outer handle 14, the resilient member 22 abutting against an outer face of the base member 13 when the outer handle 14 is in the non-operated position, and when the outer handle 14 spring-biased toward the non-operated position side returns from an operated position toward the non-operated position side, since the resilient member 22 abuts against the base member 13, the outer handle 14 does not come into colliding contact with the base member 13.

Furthermore, the outer handle 14 is pivoted from the non-operated position to the operated position by pulling the operation portion 14*a* thereof, and a housing recess 23 that houses at least part of the operation portion 14*a*, in this embodiment one end part of the operation portion 14*a*, is provided in the base member 13. The housing recess 23 is formed from the first recess 18 of the base member 13 and a cover member 24 made of a synthetic resin and detachably mounted on the base member 13, and the cover member 24 is formed as a separate body from the outer handle 14 so as to form a part of the housing recess 23 while forming a design surface of the base member 13. This cover member 24 is formed into an inwardly recessed shape while blocking the second recess 19 of the base member 13 from the outside and being smoothly connected to the first recess 18, and is detachably mounted on the base member 13 in a state in which it abuts against the step 20 between the first and second recesses 18 and 19.

A pair of projections 25 and 25 are integrally and projectingly provided on an end part of the cover member 24 on the side opposite to the operation portion 14*a* of the outer handle 14, and fitting holes 26 are provided in the base member 13, the projections 25 being fitted into the fitting holes 26.

Figure 4:
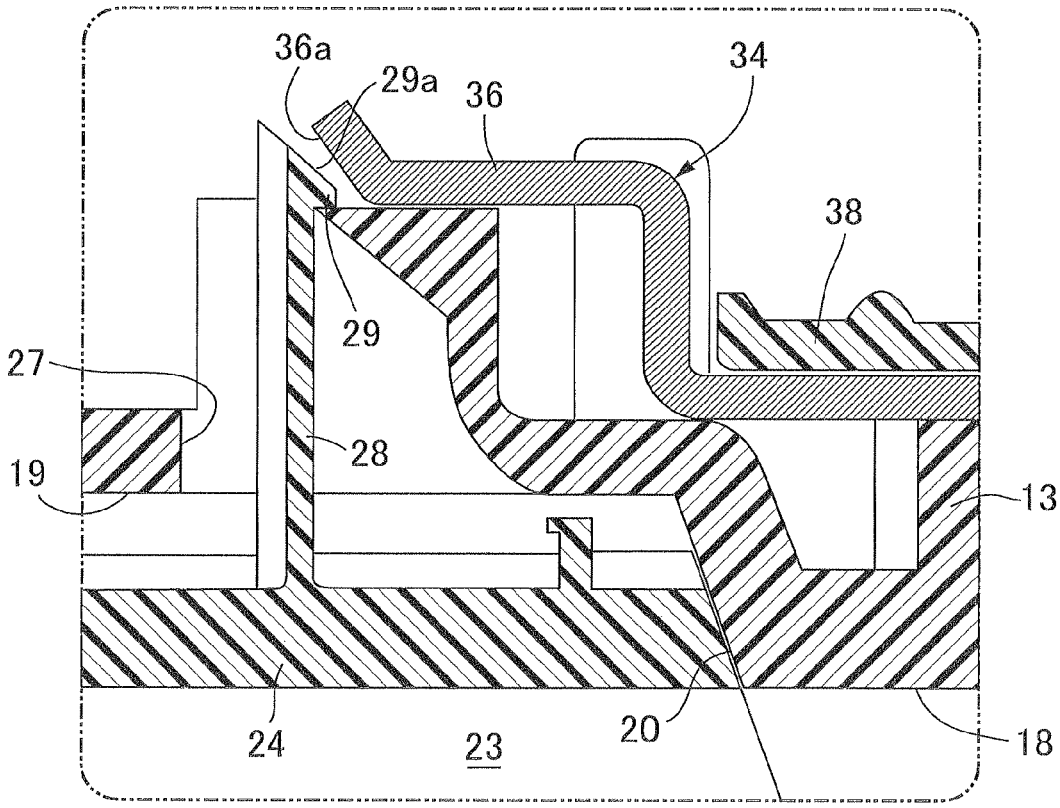
FIG. 4 is an enlarged view of a part indicated by an arrow 4 in FIG. 2.

Referring in addition to FIG. 4, an engagement hole 27 is provided in a portion, close to the first recess 18, of the second recess 19 of the base member 13, and a mounting projection 28 is provided integrally with an inner face of the cover member 24 so that it can be inserted into the engagement hole 27 from the outside of the vehicle door 11, the mounting projection 28 having at the tip end an engagement claw 29 that can be resiliently engaged with the inner end edge of the engagement hole 27. That is, the cover member 24 can be detachably mounted on the base member 13 by pressing it against the outer face side of the base member 13 in a state in which the two projections 25 are fitted into the fitting holes 26.

Figure 5:
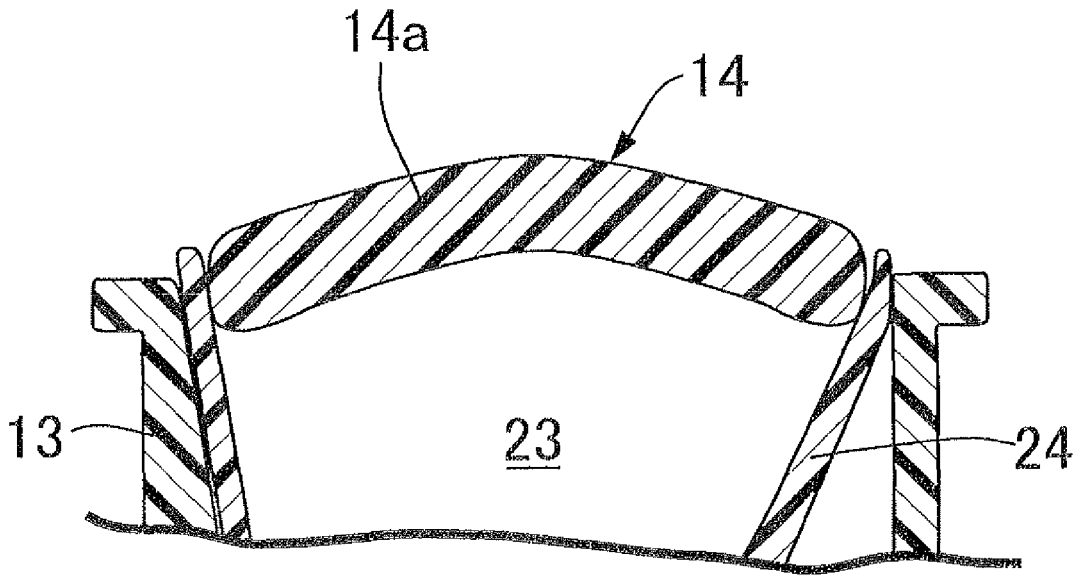
FIG. 5 is a cross-sectional view taken along a line 5-5 in FIG. 1.

Moreover, the cover member 24 and the operation portion 14*a* of the outer handle 14 are formed so that the operation portion 14*a* and a part of the cover member 24 overlap one another when viewed from the outside of the vehicle door 11, and as shown in FIG. 5 the operation portion 14*a* abuts against the cover member 24 from the outside in a state in which the outer handle 14 is in the non-operated position.

Furthermore, the cylinder lock 15 is mounted on the inner face side of the base member 13. The cylinder lock 15 is mounted on the inner face side of the base member 13 so that a key hole 32 of a rotor 31 of the cylinder lock 15 faces a through hole 33 provided in the second recess 19 of the base member 13. As a result, the second recess 19 is covered by the cover member 24 detachably mounted on the base member 13, and the through hole 33 and the key hole 32 are also covered by the cover member 24.

Resilient engagement of the engagement claw 29 with the inner end edge of the engagement hole 27 is released by operation of engagement release means 34 having an engagement release-operation portion 35 projecting outward from the outer face of the base member 13, and portions of the engagement release means 34 apart from the engagement release-operation portion 35 are disposed on the inner face side of the base member 13.

Figure 2:
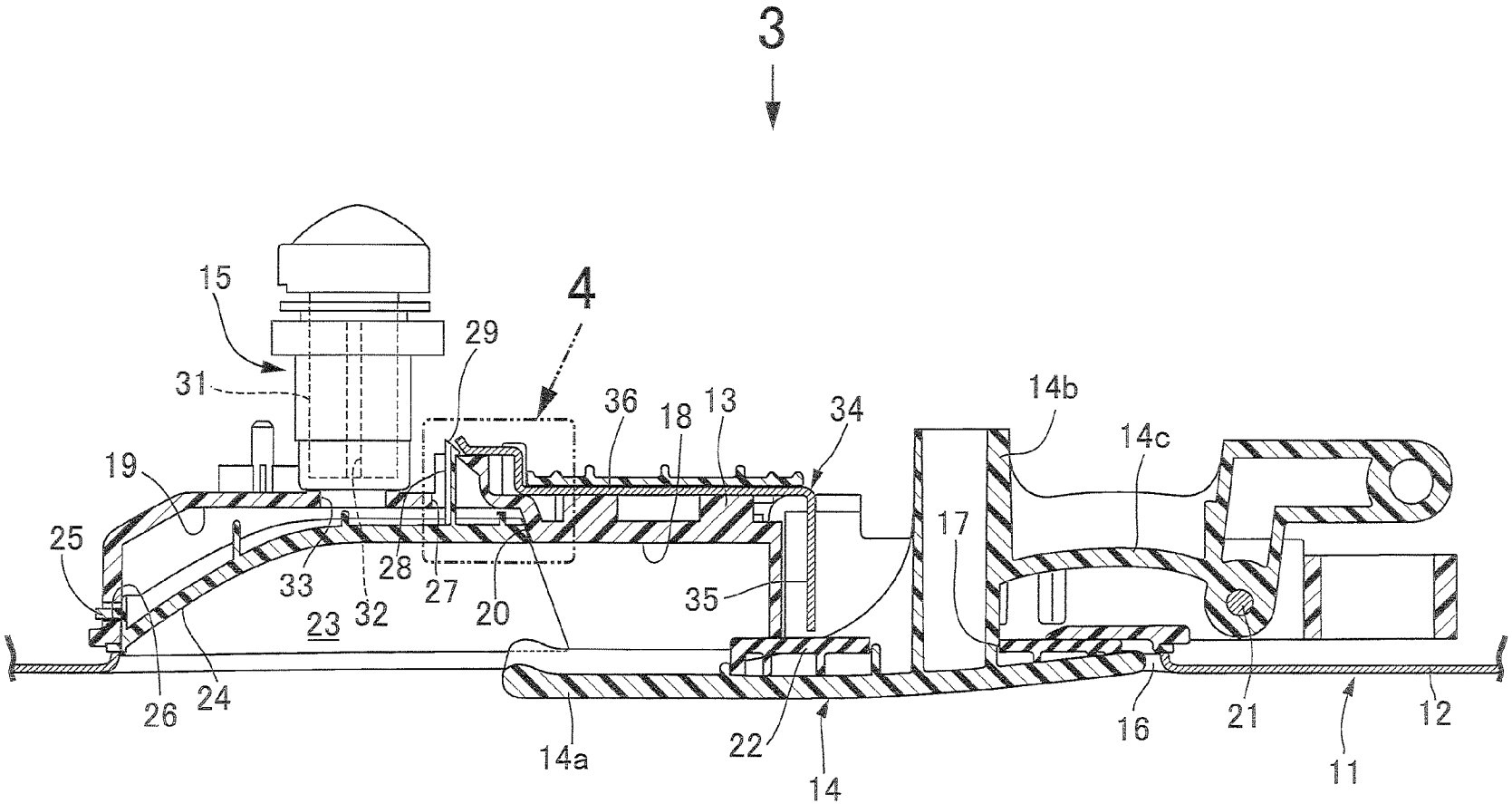
FIG. 2 is a cross-sectional view taken along a line 2-2 in FIG. 1.
Figure 3:
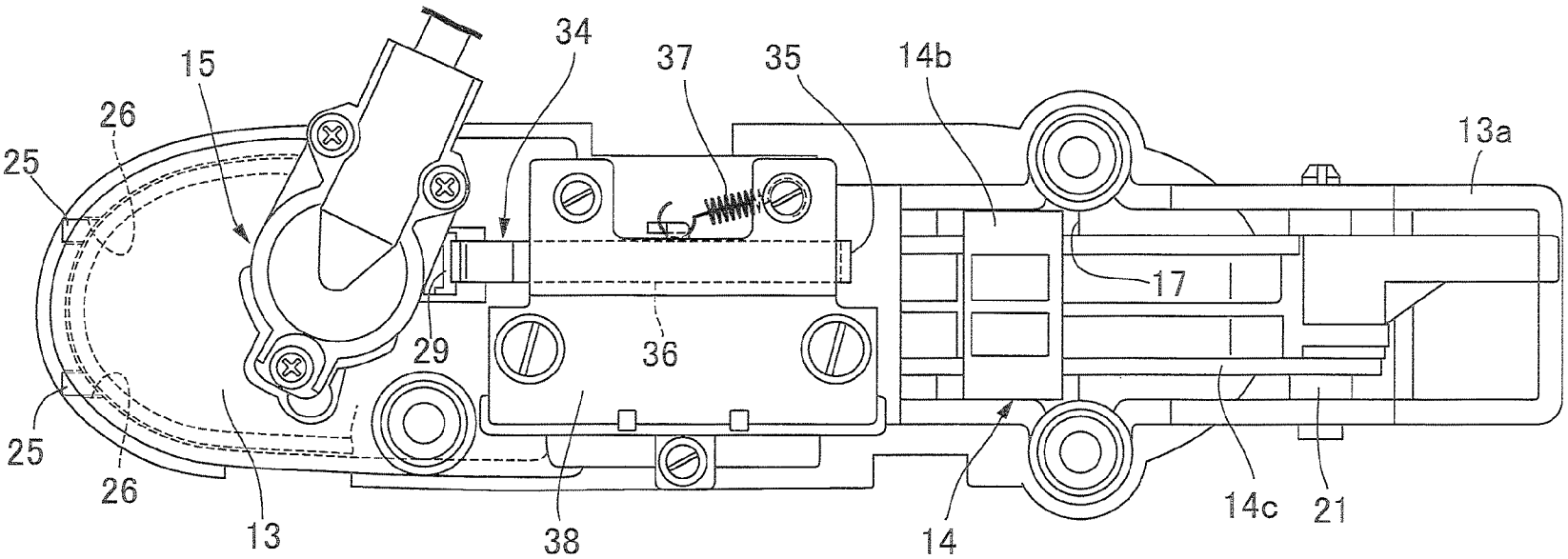
FIG. 3 is a back view seen from a direction of an arrow 3 in FIG. 2.

Referring to FIG. 2 and FIG. 3, a sensor cover 38 housing an unlock sensor (not illustrated) between itself and the base member 13 is mounted on the inner face of the base member 13 in a portion corresponding to the first recess 18. The engagement release means 34 is formed from a pressing member 36, a spring 37, and the engagement release-operation portion 35, the pressing member 36 being formed into a flat plate shape extending in the fore-and-aft direction of the vehicle so that one end part thereof can abut against the engagement claw 29 in resilient engagement with the inner end edge of the engagement hole 27 and being slidably retained between the base member 13 and the sensor cover 38, the spring 37 being provided in a contracted state between the pressing member 36 and the base member 13 while exhibiting a spring force that spring-biases said one end part of the pressing member 36 toward the side on which it moves away from the engagement claw 29, and the engagement release-operation portion 35 being provided so as to be integrally connected to the other end of the pressing member 36 at right angles. The engagement release-operation portion 35 is disposed at a position in which it is covered by the operation portion 14*a* of the outer handle 14 in the non-operated position.

Figure 6:
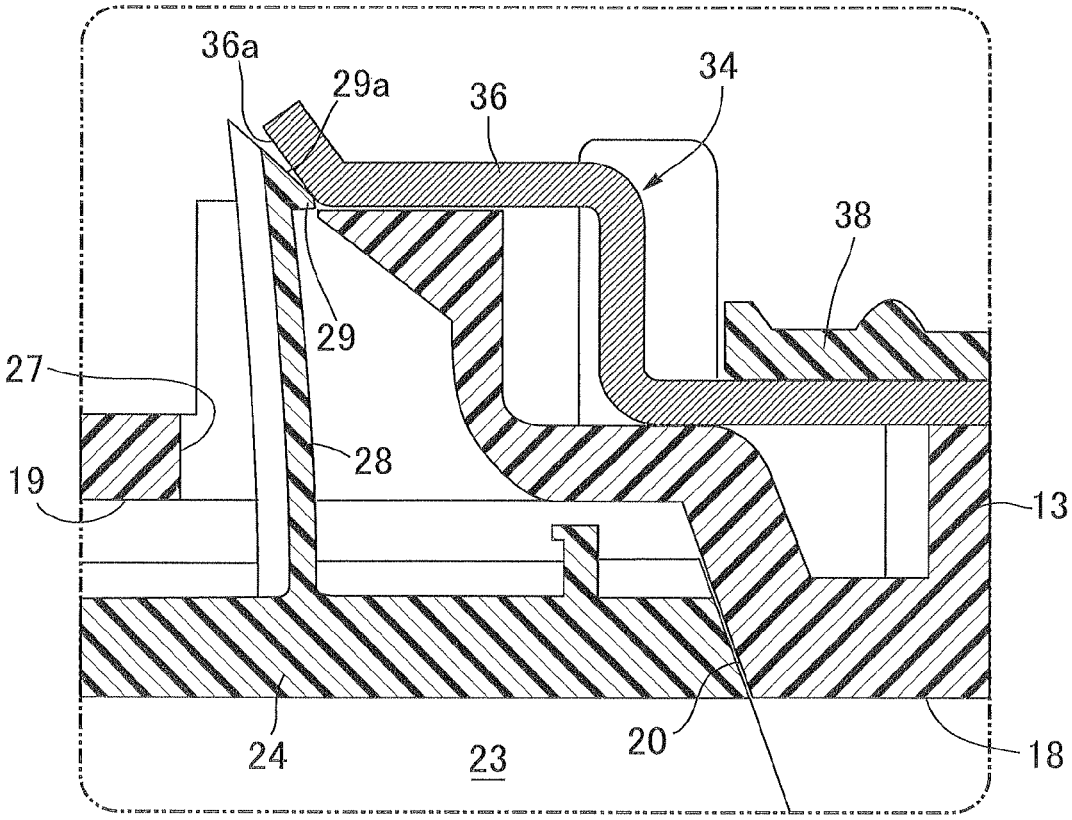
FIG. 6 is a cross-sectional view corresponding to FIG. 4 in a state in which an engagement claw is pressed by a pressing member toward a side to release an engagement with an inner end edge of an engagement hole.

When the engagement release-operation portion 35 is operated so that the pressing member 36 slides against the spring force of the spring 37 toward the side on which it presses against the engagement claw 29 side, as shown in FIG. 6 the engagement claw 29 abutting against said one end part of the pressing member 36 is pressed toward the side on which it is detached from the inner end edge of the engagement hole 27, and engagement of the engagement claw 29 with the inner end edge of the engagement hole 27 is thereby released.

Figure 7:
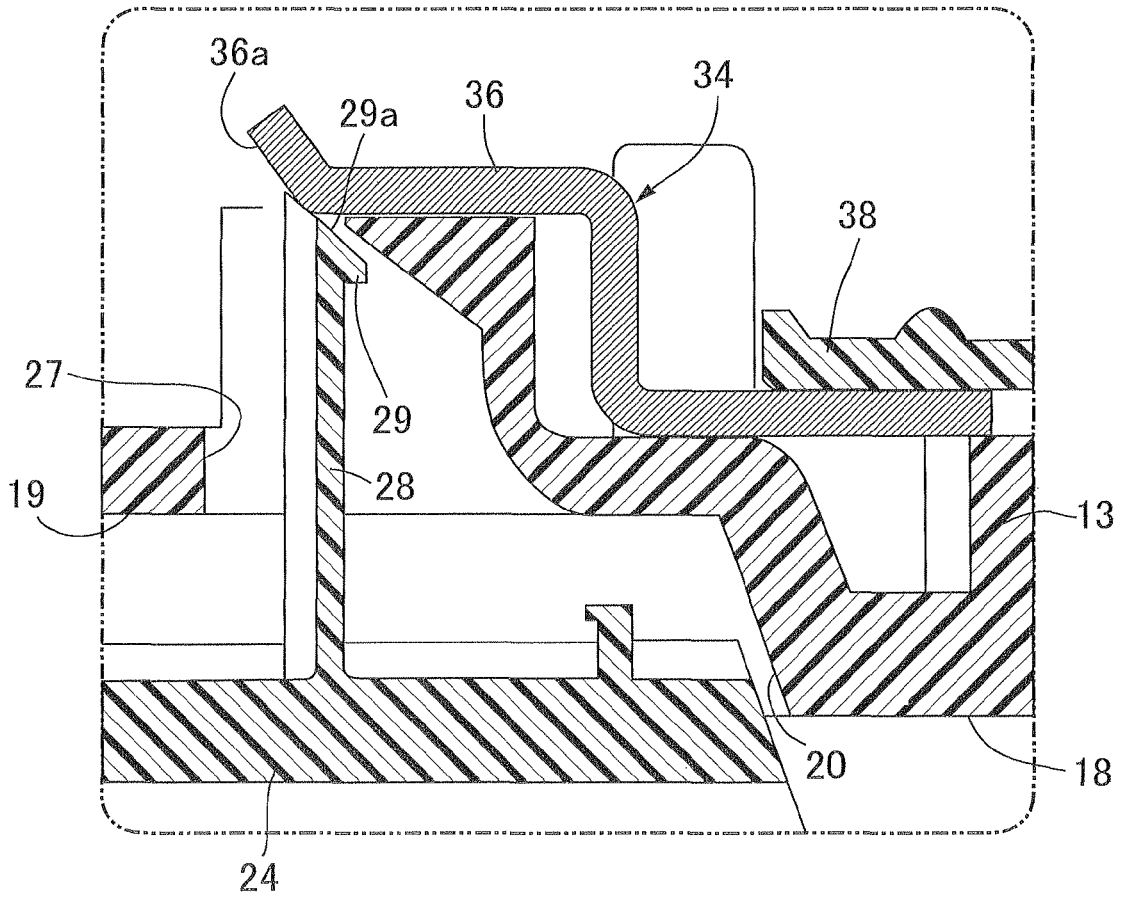
FIG. 7 is a cross-sectional view corresponding to FIG. 4 in a state in which a mounting projection is driven toward the outside of a vehicle door.

Moreover, at least one of abutment faces 29*a* and 36*a* of the engagement claw 29 and the pressing member 36, in this embodiment both of the abutment faces 29*a* and 36*a*, is formed as an inclined face that converts a pressing force exerted on the engagement claw 29 by the pressing member 36 into a force that drives the mounting projection 28 toward the outside of the vehicle door 11, and as shown in FIG. 7 the cover member 24 and the mounting projection 28 having the engagement claw 29 disengaged from the inner end edge of the engagement hole 27 are driven toward the outside of the vehicle door 11.

The operation of this embodiment is now explained. Since the cover member 24, which forms a part of the housing recess 23 and is formed as a separate body from the outer handle 14, is detachably mounted on the base member 13 so as to cover the key hole 32 of the cylinder lock 15, the key hole 32 of the cylinder lock 15 is not exposed to the outside as a result of operation of the outer handle 14. Furthermore, since the cover member 24 forms a design surface of the base member 13, it is not easy to notice that it is the cover member 24 when viewed from the outside of the vehicle door 11, and since it is difficult to identify the position of the cylinder lock 15, excellent theft-proofness can be obtained.

Furthermore, since the operation portion 14*a* of the outer handle 14 and the cover member 24, which is detachably mounted on the base member 13 by pressing against the outer face of the base member 13, are formed so that the operation portion 14*a* and a part of the cover member 24 overlap one another when viewed from the outside of the vehicle door 11 so that the operation portion 14*a* abuts against the cover member 24 from the outside in a state in which the outer handle 14 is in the non-operated position, when the cover member 24 is mounted on the base member 13, the operation portion 14*a* of the outer handle 14 spring-biased toward the non-operated position side abuts against the cover member 24 when the outer handle 14 is in the non-operated position, and it is therefore possible to reliably mount on the base member 13 the cover member 24, which is mounted on the base member 13 by pressing it against the outer face of the base member 13.

Furthermore, since the engagement hole 27 is provided in the base member 13, the mounting projection 28 having at its tip end the engagement claw 29 that can resiliently engage with the inner end edge of the engagement hole 27 is provided on the cover member 24 so as to be insertable into the engagement hole 27 from the outside of the vehicle door 11, portions other than the engagement release-operation portion 35 of the engagement release means 34 that has the engagement release-operation portion 35 projecting outward from the outer face of the base member 13 and can release the engagement of the engagement claw 29 with the inner end edge of the engagement hole 27 in accordance with operation of the engagement release-operation portion 35 are disposed on the inner face side of the base member 13, and the engagement release-operation portion 35 is disposed at a position in which it is covered by the operation portion 14*a* of the outer handle 14 in the non-operated position, it is possible to operate the engagement release-operation portion 35 only in a state in which the outer handle 14 is pivoted to the operated position by pulling the operation portion 14*a*, thereby making it difficult for the engagement release-operation portion 35 to be operated undesirably by tampering, etc.

Furthermore, since the engagement release means 34 includes the pressing member 36 that can abut against the engagement claw 29 so that it can exert on the engagement claw 29 a pressing force in the direction that releases engagement of the engagement claw 29 with the inner end edge of the engagement hole 27 in accordance with operation of the engagement unlock operation portion 35, and at least one of the abutment faces 29*a* and 36*a* of the engagement claw 29 and the pressing member 36 (in this embodiment both of the abutment faces 29*a* and 36*a*) is formed as an inclined face that converts a pressing force exerted on the engagement claw 29 by the pressing member 36 into a force that drives the mounting projection 28 toward the outside of the vehicle door 11, it is easy for the cover member 24 to be detached from the base member 23.

An embodiment of the present invention is explained above, but the present invention is not limited to the above-mentioned embodiment and may be modified in a variety of ways as long as the modifications do not depart from the gist of the present invention.

What is claimed is:

1. A vehicle door outer handle device in which an inwardly recessed housing recess is provided in a base member fixed to a vehicle door, an outer handle having an operation portion is pivotably supported on the base member and pivoting to an operated position in accordance with pulling of the operation portion and being spring-biased toward a non-operated position, at least part of the operation portion being disposed in the housing recess, and a cylinder lock is mounted on the base member such that a key hole is covered at least in a state in which the outer handle is in the non-operated position, wherein a cover member is detachably mounted on the base member and covers the key hole, the cover member being formed as a separate body from the outer handle and the base member, and that part of an inner surface of the housing recess which is visible from an outside of the vehicle door is entirely formed by an outer surface of the cover member and one end of the outer surface of the cover member is continuous with an opening end of the housing recess.

2. The vehicle door outer handle device according to claim 1, wherein the operation portion and the cover member, which is detachably mounted on the base member by pressing the cover member against an outer face of the base member, are formed so that the operation portion and part of the cover member overlap one another when viewed from the outside of the vehicle door so that the operation portion abuts against the cover member from the outside in a state in which the outer handle is in the non-operated position.

3. The vehicle door outer handle device according to claim 1 or 2, wherein an engagement hole is provided in the base member, a mounting projection is provided on the cover member so as to be insertable into the engagement hole from the outside of the vehicle door, the mounting projection having at a tip end an engagement claw that resiliently engages with an inner end edge of the engagement hole, an engagement release means has an engagement release-operation portion projecting outward from an outer face of the base member and is able to release engagement of the engagement claw with the inner end edge of the engagement hole in accordance with operation of the engagement release-operation portion, portions of the engagement release means apart from the engagement release-operation portion are disposed on an inner face side of the base member, and the engagement release-operation portion is disposed at a position in which the engagement release-operation portion is covered by the operation portion of the outer handle in the non-operated position.

4. The vehicle door outer handle device according to claim 3, wherein the engagement release means comprises a pressing member that abuts against the engagement claw so that it exerts on the engagement claw in accordance with operation of the engagement release-operation portion a pressing force in a direction that releases engagement of the engagement claw with the inner end edge of the engagement hole, and at least one of abutment faces of the engagement claw and the pressing member is formed as an inclined face that converts the pressing force exerted on the engagement claw by the pressing member into a force that drives the mounting projection toward the outside of the vehicle door.

5. A vehicle door outer handle device in which an inwardly recessed housing recess is provided in a base member fixed to a vehicle door, an outer handle having an operation portion is pivotably supported on the base member and pivoting to an operated position in accordance with pulling of the operation portion and being spring-biased toward a non-operated position, at least part of the operation portion being disposed in the housing recess, and a cylinder lock is mounted on the base member such that a key hole is covered at least in a state in which the outer handle is in the non-operated position, wherein a cover member is detachably mounted on the base member and covers the key hole, the cover member being formed as a separate body from the outer handle and forms part of the housing recess while forming a surface of the base member, and wherein the operation portion and the cover member, which is detachably mounted on the base member by pressing the cover member against an outer face of the base member, are formed so that the operation portion and part of the cover member overlap one another when viewed from the outside of the vehicle door so that the operation portion abuts against the cover member from the outside in a state in which the outer handle is in the non-operated position.

6. A vehicle door outer handle device in which an inwardly recessed housing recess is provided in a base member fixed to a vehicle door, an outer handle having an operation portion is pivotably supported on the base member and pivoting to an operated position in accordance with pulling of the operation portion and being spring-biased toward a non-operated position, at least part of the operation portion being disposed in the housing recess, and a cylinder lock is mounted on the base member such that a key hole is covered at least in a state in which the outer handle is in the non-operated position, wherein a cover member is detachably mounted on the base member and covers the key hole, the cover member being formed as a separate body from the outer handle and forms part of the housing recess while forming a surface of the base member, and wherein an engagement hole is provided in the base member, a mounting projection is provided on the cover member so as to be insertable into the engagement hole from the outside of the vehicle door, the mounting projection having at a tip end an engagement claw that resiliently engages an inner end edge of the engagement hole, an engagement release means has an engagement release-operation portion projecting outward from an outer face of the base member and is able to release engagement of the engagement claw with the inner end edge of the engagement hole in accordance with operation of the engagement release-operation portion, and the engagement release-operation portion is disposed at a position in which the engagement release-operation portion is covered by the operation portion of the outer handle in the non-operated position.

7. The vehicle door outer handle device according to claim 6, wherein the engagement release means comprises a pressing member that abuts against the engagement claw so that it exerts on the engagement claw in accordance with operation of the engagement release-operation portion a pressing force in a direction that releases engagement of the engagement claw with the inner end edge of the engagement hole, and at least one of abutment faces of the engagement claw and the pressing member is formed as an inclined face that converts the pressing force exerted on the engagement claw by the pressing member into a force that drives the mounting projection toward the outside of the vehicle door.

* * * * *